US007310925B2

(12) United States Patent
Monti

(10) Patent No.: US 7,310,925 B2
(45) Date of Patent: Dec. 25, 2007

(54) STATION FOR WITHDRAWING AND ERECTING FLAT FOLDED TUBULAR BLANKS

(75) Inventor: Giuseppe Monti, Pianoro (IT)

(73) Assignee: Marchesini Group S.p.A., Bologna (IT)

( * ) Notice: Subject to any disclaimer, the term of this patent is extended or adjusted under 35 U.S.C. 154(b) by 0 days.

(21) Appl. No.: 11/524,093

(22) Filed: Sep. 20, 2006

(65) Prior Publication Data

US 2007/0072756 A1 Mar. 29, 2007

(51) Int. Cl.
*B65B 43/30* (2006.01)
*B31B 1/76* (2006.01)

(52) U.S. Cl. ..... 53/566; 493/309; 493/313

(58) Field of Classification Search ..... 53/457, 53/458, 468, 564, 566; 493/309, 313, 317
See application file for complete search history.

(56) References Cited

U.S. PATENT DOCUMENTS 3,022,615 A * 2/1962 Schroeder et al. ..... 53/458
3,613,526 A * 10/1971 Jones ..... 493/313
3,633,470 A * 1/1972 Bingham ..... 53/566
4,081,945 A * 4/1978 Calvert et al. ..... 53/566
4,358,918 A * 11/1982 Groom et al. ..... 53/566
4,531,931 A * 7/1985 Dietrich ..... 493/317
4,709,538 A * 12/1987 Olsen et al. ..... 53/566
4,930,291 A * 6/1990 Buisseau ..... 53/564
5,027,586 A * 7/1991 Ramaker ..... 53/566
5,127,894 A * 7/1992 Maccaferri ..... 493/316
5,359,834 A * 11/1994 Holdensgaard et al. ..... 53/566
5,415,615 A * 5/1995 Culpepper ..... 493/315
5,454,215 A * 10/1995 Martelli ..... 53/564
5,473,868 A * 12/1995 Antonio ..... 53/566
5,531,661 A * 7/1996 Moncrief ..... 493/313
5,562,581 A * 10/1996 Roberto et al. ..... 53/566
5,613,828 A * 3/1997 Haddow et al. ..... 53/564
5,653,671 A * 8/1997 Reuteler ..... 493/313
5,713,187 A * 2/1998 Peterson ..... 53/566
5,791,124 A * 8/1998 Spatafora ..... 53/456
6,050,063 A * 4/2000 Ford et al. ..... 53/566
6,915,622 B2 * 7/2005 Spatafora ..... 53/566
7,024,838 B2 * 4/2006 Freemantle ..... 53/566

* cited by examiner

*Primary Examiner*—Louis Huynh
(74) *Attorney, Agent, or Firm*—William J. Sapone; Coleman Sudol Sapone P.C.

(57) ABSTRACT

In a station of a boxing machine, for withdrawing and erecting flat folded tubular blanks into boxes, a blank withdrawing rocker arm strips out a flat folded blank from a magazine and places it onto a operating member situated below and associated to an auxiliary conveying line. The auxiliary conveying line extends along a close loop path. Gripping suction cups associated to the operating member engage the lower side of the blank. An erecting arm with a shaped flap makes edge-resting sides of the blank rotate synchronously, about respective articulation lines adjoining to a lower side, until a corresponding box is erected. A shaped guide engages with the carriage and moves the box laterally with respect to the auxiliary conveying line, to insert the box into a corresponding seat on a box conveying line situated beside the auxiliary conveying line.

8 Claims, 4 Drawing Sheets

STATION FOR WITHDRAWING AND ERECTING FLAT FOLDED TUBULAR BLANKS

FIELD OF THE INVENTION

The invention relates to the automatic machines for packaging articles, known as boxing machines.

BACKGROUND OF THE INVENTION

According to a widespread design, the boxing machines include a magazine, in which the tubular blanks are piled up, in flat folded configuration, and then withdrawn therefrom one by one, erected to define open boxes, and finally placed onto a box conveying line, which extends besides an article conveying line; the box conveying line and the article conveying line are moved in reciprocal step relation. The articles are introduced into the boxes by pushing means, moving longitudinally, synchronously with said conveying lines, and operated crosswise thereto; the boxes are then closed by suitable devices, situated downstream, along the box conveying line.

Erecting flat folded tubular blanks into boxes, after their withdrawal from the magazine, is known in technical jargon as "rhombus-opening", and includes the rotation of the box sides, along articulation lines (creasing) already made in the blank, so as to set them at right angles with respect to the two remaining horizontal sides.

Many technical solutions have been invented to carry out the above mentioned operation, each of which aimed at optimizing the results in relation to two factors: the first factor is the blanks natural tendency to close again, due to the elastic return, as a reaction to the erecting action, and the second factor is the need to make the machine suitable for box different sizes.

The above technical. solutions are divided, due to the design basic idea, into two types: the first type includes erecting of the blanks by the striking against stop elements and the other one includes means, which are controlled to act positively on the blanks.

Moreover, there are known hybrid solutions, including both controlled erecting means and fixed stop elements.

When the action of the controlled means is aimed at making the box edge-resting sides rotate in the same direction as the machine feeding direction, an opening action occurs which is known as "positive opening".

A solution of known type, conceived by the owner of this Application, includes withdrawing the flat folded blank from the bottom of the magazine, bringing the same to strike first fixed stop elements, which cause its erecting, and consequently erecting the box. Then, the box is placed on an additional conveying line, having second fixed stop elements, aimed at keeping erected the box, which is subsequently brought to the proper box conveying line, prepared for receiving the articles in the above mentioned way.

The drawbacks of this technical solution result from a certain difficulty in setting the position of various fixed stop elements, to minimize the blank elastic return, when it is placed on the additional conveying line.

Actually, during this passage, the blank is already disengaged from the first stop elements, but not yet engaged with the second ones.

The above setting up difficulties are further remarked at every size changeover, due to different dimensions and/or different proper characteristics of the elastic return of each type of box.

The obvious consequences of the above mentioned drawback are the machine prolonged downtimes at size changeover, the necessity of tests and adjustment fine tuning, as well as the increase of the jamming possibility, in particular during the passage between the additional conveying line and the box conveying line, if the boxes are not correctly squared.

SUMMARY OF THE INVENTION

The object of the present invention is to propose a station for withdrawing flat folded blanks and for erecting thereof, in which the operating means are made in such a way, as to positively open the box and to maintain always controlled the arrangement of the box sides, until the box is inserted into a corresponding seat made on the box conveying line, thus avoiding the above mentioned disadvantages.

Another object of the present invention is to propose a station, in which it is possible to withdraw and erect blanks of dimensions varying from a minimum size to maximum size within a wide acceptable range, ensuring a reliable operation, particularly when the height of box edge-resting sides changes.

A further object of the present invention relates to the need for rapid adjustments of the work means in the proposed station, due to the box size changeover, without jeopardizing the operation reliability of the whole machine.

The above mentioned objects are achieved in a boxing machine including:

- a magazine for flat folded box blanks, disposed in a pile, to be erected into corresponding boxes;
- a station for withdrawing and erecting said flat folded tubular blanks into boxes;
- a box conveying line extending beside said station for conveying erected boxes obtained from said folded box blanks and introduced, by a transversal movement, into seats made on said box conveying line;
- an article conveying line situated beside said box conveying line on a side opposite to said station;
- pushing means situated downstream of said station for transferring said article from the article conveying line into said boxes conveyed along said box conveying line;

in that said station for withdrawing and erecting said flat folded tubular blanks includes:

- an auxiliary conveying line, that extends along a close loop path below said box conveying line and near to said magazine;
- withdrawing means for withdrawing said flat folded blank from bottom of said pile contained in said magazine and for placing withdrawn flat folded blanks onto said auxiliary conveying line;
- operating member associated to said auxiliary conveying line for receiving said blanks being erected into boxes;
- gripping suction cups associated to each operating member of said operating members, for engaging a lower side of one blank held by said withdrawing means;
- controlled erecting means situated in each operating member of said operating members for making edge-resting sides of a relevant blank rotate synchronously, about respective articulation lines adjoining said lower side, until a quadrilateral box is defined;
- transferring means situated in each operating member of said operating members for moving said box laterally with respect to said auxiliary conveying line for inserting said box into a corresponding seat on said box conveying line.

BRIEF DESCRIPTION OF THE DRAWINGS

The characteristic features of the invention will be pointed out in the following description of a preferred embodiment of the proposed station, in accordance with the contents of the claims and with the help of the enclosed figures, in which:

DISCLOSURE OF THE PREFERRED EMBODIMENTS

Figure 1:
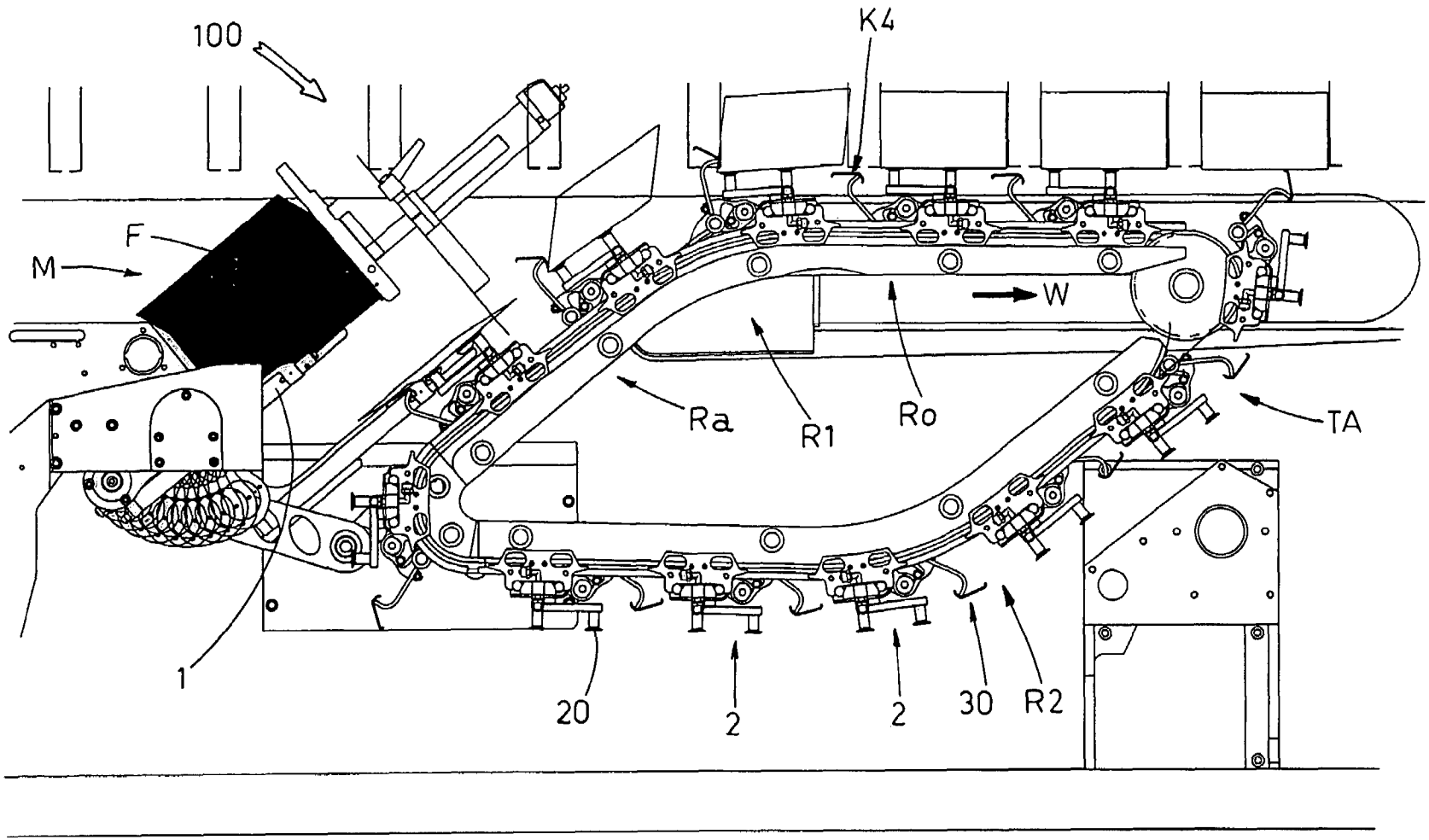
FIG. 1 is a lateral view of the station.

Having regards to the above Figures, reference numeral 100 indicates the proposed station, associated to a boxing machine, of substantially known type, which can be operated continuously or stepwise.

A magazine M, situated in the station 100, houses flat folded blanks F, piled up, aimed at being stripped away one by one from the pile bottom, by withdrawing means 1, e.g. a rocker arm, having suction cups set under vacuum condition.

An auxiliary conveying line TA is situated downstream of the withdrawing means 1 and extends along an endless loop path, which defines a work run R1 and a return run R2, along the operation direction W.

The work run R1 includes, in turn, an upward portion Ra, followed by a horizontal portion Ro (FIG. 1).

A box conveying line TS of the boxing machine begins beside the auxiliary conveying line TA and extends parallel thereto, in the feeding direction W of the latter. The box conveying line TS extends in a way that, in turn, it is placed beside an article conveying line, not shown as known, situated on the opposite side with respect to the station 100.

The box conveying line TS and the article conveying line are operated in step relation with each other and with the auxiliary conveying line TA, in the same feeding direction W.

Sets 2 of operating members are disposed stepwise along the auxiliary conveying line TA, and include each gripping means 20 formed by suction cups, controlled erecting means 30 and transferring means 40.

The gripping suction cups 20 engage the lower side L1 of the blank F, as it will be better described later, and are carried by a bracket 21, fastened removably to a carriage 22.

The carriage 22 slides in a direction transversal to the line TA on guiding stems 23 (FIGS. 2, 6, 7), whose both ends are fastened to relevant sliding blocks 24 guided along the paths 25, formed along the close loop path of the line TA.

The bracket 21 is box-size-matched in such a way that, when the blank F dimension is changed, the bracket must be substituted integrally with the gripping suction cups 20, so as to make the arrangement of the suction cups correspond to the lower side L1 of the blank F.

The height of the gripping suction cups 20 is kept constant independently from the blanks F size, so as not to change the level, at which the lower side L1 of the blank F is placed in the horizontal portion Ro of the work run R1.

Consequently, the upper horizontal run of the box conveying line TS is kept at a fixed predetermined height, suitable for receiving boxes from the line TA, as it will be described in the following.

The controlled erecting means 30 are aimed at acting on the edge-resting side L3, situated behind the lower side L1, with respect to the feeding direction W, and include a shaped flap 31, fastened to an arm 32, which is pivoted to a pivot point 33 of a plate 34.

The plate 34 is integral with one of the sliding blocks 24, carrying the stems 23.

In particular, the erecting means 30 are situated on the side of the auxiliary conveying line TA, which is beside the box conveying line TS.

The arm 32 has an idle roller 35, which follows the profile of a linear cam 36, extending in the work run R1 of the line TA, so as to determine the arrangement of the arm 32 and consequently, of the shaped flap 31, as it will be described in a more detailed way in the following.

The arm 32 oscillation range is limited by abutment means 320, including e.g. a pin 321, fastened to the plate 34 and engaged with a slot 322, made in the arm 32.

The shaped flap 31 is suitably dimensioned, so as to strike the edge-resting side L3 near the articulation (pre-creasing) line, which joins it to the lower side L1, so as to make it suitable to act on edge-resting sides L3 of any height, without adjustment.

The transferring means 40 are aimed at acting on the carriage 22 of each moving element 2, during the passage of the work run R1 of the line TA, so as to determine its transversal positioning.

The transferring means 40 include e.g. a shaped guide 41, situated below the carriages 22, shown schematically in FIG. 2 with a line reproducing its course.

Suitable devices, not shown, situated in each carriage 22, engage with the shaped guide 41.

Now, the working of the station 100 will be described, in relation to a working cycle of a blank F.

As it has already been mentioned previously, the flat folded blank F is stripped out from the bottom of the pile in the magazine M, by the suction cups of the rocker arm 1, which act on the portion of the blank F, aimed at forming the lower side L1.

In the shown example, the control compound lever of the rocker arm 1 allows the blank, in a way known in itself, to translate substantially parallel with respect to inclination of the blanks pile, which therefore, in the case in point, is the same as the one of the upward portion Ra of the auxiliary line TA.

The flat folded blank F is placed on the gripping suction cups 20 of the corresponding moving element 2, situated below, which are set under vacuum condition in suitable step relation with the deactivation of the suction cups of the rocker arm 1; obviously, the arrangement of the latter is such that they do not interfere with the gripping suction cups 20.

Figure 3:
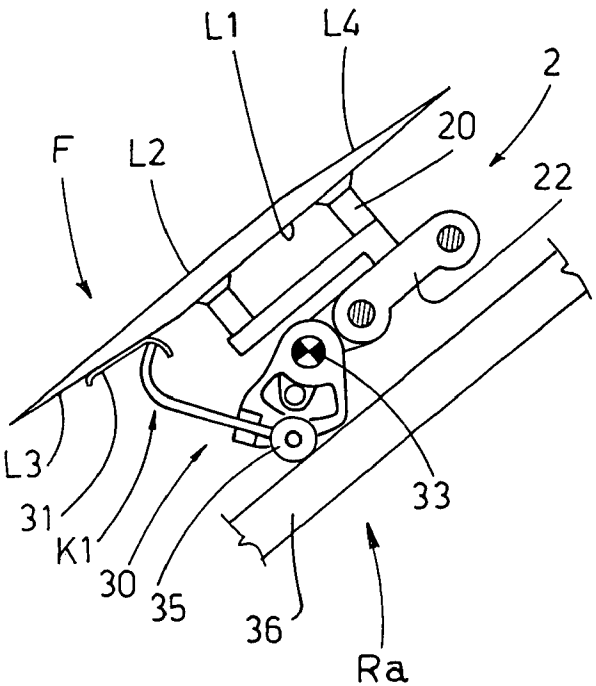

During this step, the shaped flap 31 is kept, by the linear cam 36, in a receiving, lowered position K1, so as to support the edge-resting side L3 (FIGS. 1 and 3).

Figure 2:
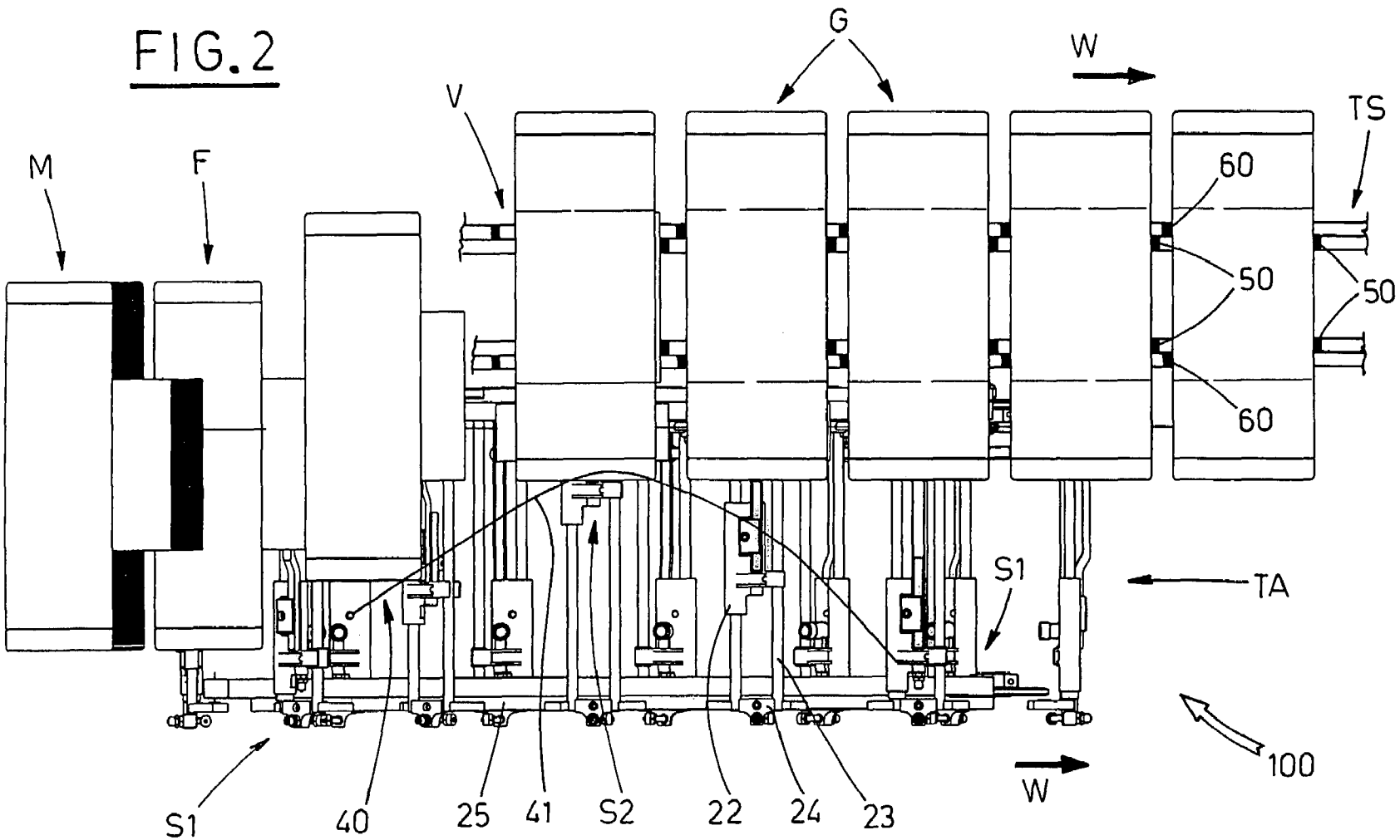
FIG. 2 is a top view of the same.
Figure 6:
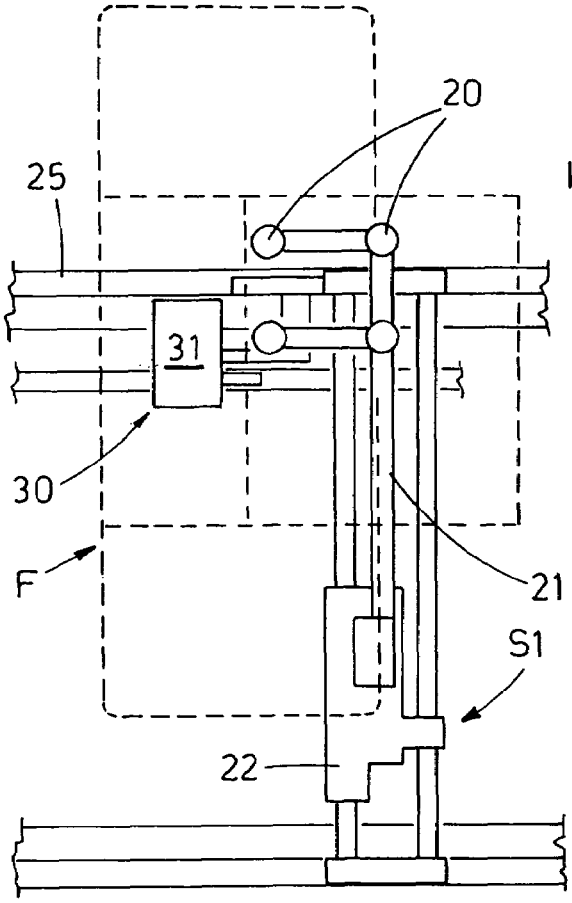
FIG. 6 is a top view of the step corresponding to the one of FIG. 3, with the blank indicated with broken line.

The carriage 22 is placed, by the shaped guide 41, in the position S1, transversely farther with respect to the box conveying line TS (FIGS. 2 and 6).

The movement of the moving element 2 along the upward portion Ra, together with the change of the linear cam 36 profile, start, by causing the upward oscillation of the shaped flap 31, the rhombus-opening operation, in order to erect the flat folded blank F, which occurs with the rotation of the edge-resting side L3, in touch with the shaped flap 31 and, in synchrony, also with the other edge-resting side L4, with a consequent lifting of the upper side L2.

The oscillation of the shaped flap 31 continues up to an extreme position K2, driving said edge-resting sides L3, L4 to rotate, which make the latter go beyond the position perpendicular to the lower side L1 and the upper side L2 by a certain angle, so as to define a box G of a parallelogram shape (FIGS. 1 and 4), in order to bring beyond the "yield point" the material of the blank F, by reducing the shape memory, which would make it close again, when released.

Figure 5:
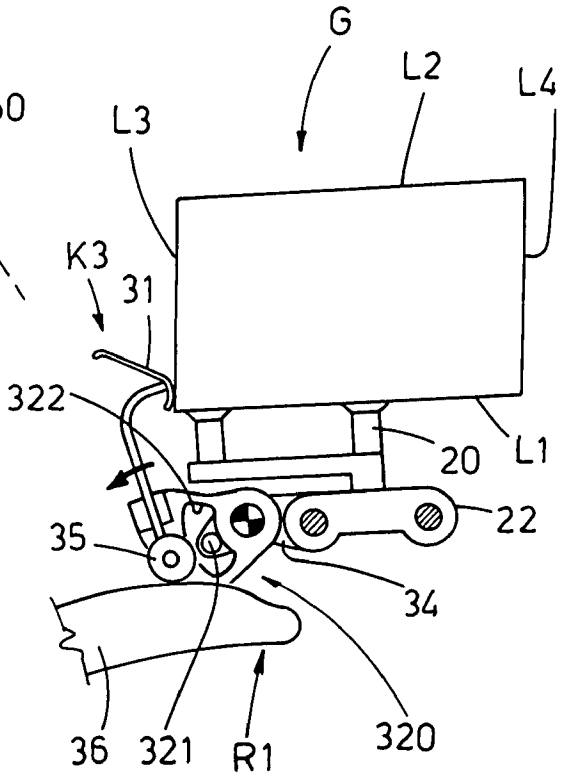
FIGS. 3, 4, 5 are lateral, enlarged views of subsequent steps of the blank erecting operation.

Between the end of the upward portion Ra and the beginning of the horizontal portion Ro of the work run R1, the profile of the linear cam 36 determines an inverse oscillation of the shaped flap 31, up to a position K3, in which the box G, following the shaped flap 31 due to the elastic return, assumes a nearly square position (FIGS. 1 and 5).

Figure 7:
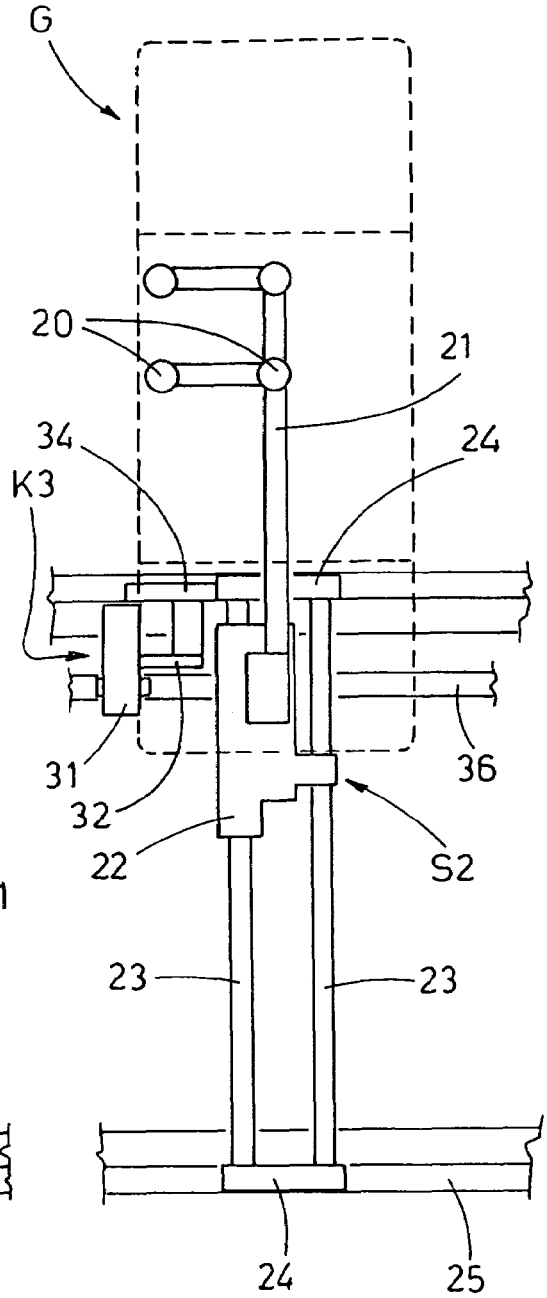
FIG. 7 is a top view of the step corresponding to the one of FIG. 5, with the blank indicated with broken line.

At the same time, the carriage 22 is made translate toward an extreme position S2, transversely closer with respect to the box conveying line TS (FIGS. 2 and 7).

The above extreme position S2 is reached in synchrony with respect to the position K3 of the shaped flap 31.

The movement of the carriage 22 causes an equal translation of the box G, which therefore begins to be inserted into a relative seat V on the box conveying line TS.

A relative sliding between the flap 31 and the edge-resting side L3 occurs during this step, without damages to the latter, due to the fact that the contact area between the two is limited and the flap surface is suitably smoothed, so as to create little friction.

Figure 4:
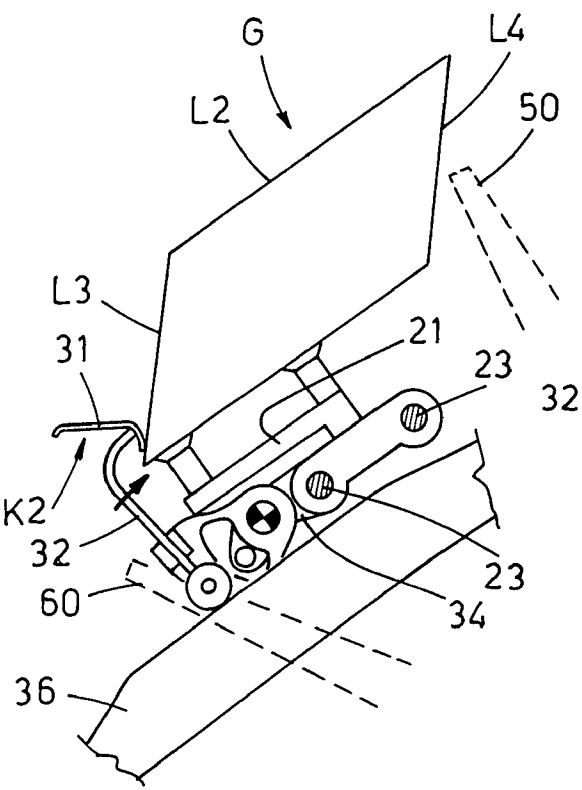

It is also to be pointed out that the above insertion is not obstructed even when the box has the parallelogram shape of FIG. 5, because the fore prongs 50 and the rear prongs 60, which define the seat V, move along the curved portion, joining the lower return run with the upper forward run of the line TS, and consequently, they are spread apart (broken lines in FIG. 4).

The box G is completely inserted, when the above positions S2 and K3 are reached respectively by the carriage 22 and the flap 31, slightly in advance with respect to the moment, in which the rear prongs 60 reach their vertical position.

Immediately afterwards, the means maintaining the gripping suction cups 20 in vacuum condition are deactivated; then, the linear cam 36 lets the flap 31 go down to its lower, rest position K4, defined by the abutment means 320, while the shaped guide 41 takes the carriage 22 back to its position S1 (see again FIG. 2).

At this point, the box G is delivered to the conveying line TS, which keeps it erected, perfectly squared, ready to receive the articles brought by the relative line and introduced by known pushing means, already mentioned in the introductory note.

The advantages of the proposed station 100 are evident from what has been said, in particular with regard to the box positive opening and the constant control of the arrangement of its sides, until its delivery to the box conveying line, avoiding all the disadvantages of the contrast erecting systems.

The described working means are simple to obtain, their working is reliable and they require only an easy operation to be adapted to the box size change.

All this allows to maintain high production speeds and to limit to minimum the machine downtimes during the size change over operations.

It is understood that what above, has been described as a mere, not limiting example. Therefore, it is obvious that any changes or variants applied to the described means remain within the protective scope defined by the following claims.

What is claimed is:

1. In a boxing machine including:

a magazine for flat folded box blanks, disposed in a pile, to be erected into corresponding boxes;

a station for withdrawing and erecting said flat folded tubular blanks into boxes;

a box conveying line extending beside said station for conveying erected boxes obtained from said folded box blanks and introduced, by a transversal movement, into seats made on said box conveying line;

an article conveying line situated beside said box conveying line on a side opposite to said station;

pushing means situated downstream of said station for transferring said article from the article conveying line into said boxes conveyed along said box conveying line;

said station for withdrawing and erecting said flat folded tubular blanks includes:

an auxiliary conveying line, that extends along a close loop path below said box conveying line and near to said magazine;

withdrawing means for withdrawing said flat folded blank from bottom of said pile contained in said magazine and for placing withdrawn flat folded blanks onto said auxiliary conveying line;

operating member associated to said auxiliary conveying line for receiving said blanks being erected into boxes;

gripping suction cups associated to each operating member of said operating members, for engaging a lower side of one blank held by said withdrawing means;

controlled erecting means situated in each operating member of said operating members for making edge-resting sides of a relevant blank rotate synchronously, about respective articulation lines adjoining said lower side, until a quadrilateral box is defined;

transferring means situated in each operating member of said operating members for moving said box laterally with respect to said auxiliary conveying line for inserting said box into a corresponding seat on said box conveying line.

2. A station, according to claim 1, including: sliding blocks guided along paths formed along the close loop path of the auxiliary conveying line;

a series of guiding stems fastened, on both sides, to said sliding blocks;

a series of carriages, which slide, crosswise to said auxiliary conveying line, on respective guiding stems;

a bracket, removably fastened to each carriage of said carriages;

gripping suction cups carried by said bracket.

3. A station, according. to claim 2, wherein said transferring means act on the carriage of each of said operating members to determine transversal positioning of said operating member during passage of the work run of said auxiliary line, said transferring means including a shaped guide, situated below said carriage, and engaging with devices made in said carriage.

4. A station, according to claim 1, wherein said controlled erecting means act on one edge-resting side situated downstream of said lower side of the blank, with respect to a forward direction of said auxiliary conveying line, with said controlled erecting means including;

an arm pivoted to a pivot point of a plate of said operating member;

a shaped flap, fastened to said arm an idle roller mounted to said arm and following a profile of a linear cam extending in the work run of the auxiliary line, so as to determine the arrangement of the arm and of the shaped flap.

5. A station, according to claim 4, wherein said plate is made integral with a sliding block situated on a side of said auxiliary conveying line situate alongside said box conveying line.

6. A station, according to claim 4, wherein said shaped flap has such dimension as to strike said edge-resting box side near the articulation line, joining said edge-resting box side to said lower box side.

7. A station, according to claim 4, wherein oscillation range for said arm is limited by abutment means including a pin fastened to the plate and engaged with a slot made in the arm.

8. A station, according to claim 1, wherein said withdrawing means include a rocker arm.

* * * * *